US005356032A

United States Patent [19]

Rhodes

[11] Patent Number: 5,356,032

[45] Date of Patent: Oct. 18, 1994

[54] FOLDED SHEET PRODUCT AND DISPENSER THEREFOR

[75] Inventor: Randel L. Rhodes, Queensbury, N.Y.

[73] Assignee: Encore Paper Company, South Glens Falls, N.Y.

[21] Appl. No.: 189,827

[22] Filed: Feb. 1, 1994

[51] Int. Cl.[5] ..... A47K 10/42

[52] U.S. Cl. ..... 221/47; 221/33; 221/38; 221/50; 221/55; 428/126; 428/130

[58] Field of Search ..... 221/33, 38, 47, 48, 221/49, 50, 55; 428/126, 130

[56] References Cited

U.S. PATENT DOCUMENTS

| | | | |
|---|---|---|---|
| 1,121,011 | 12/1914 | Hamilton et al. . | |
| 1,122,108 | 12/1914 | Hamilton | 221/47 |
| 1,256,334 | 2/1918 | Lazar . | |
| 2,027,258 | 1/1936 | Winter et al. | 221/55 X |
| 3,007,605 | 11/1961 | Donovan | 221/47 |
| 3,047,141 | 7/1962 | Burns | 221/47 X |
| 3,119,516 | 1/1964 | Donovan | 221/47 |
| 4,859,518 | 8/1989 | Schutz | 428/126 |
| 5,023,126 | 6/1991 | Stevens et al. | 428/126 |

*Primary Examiner*—Robert P. Olszewski
*Assistant Examiner*—Dean A. Reichard
*Attorney, Agent, or Firm*—Quarles & Brady

[57] ABSTRACT

A generally rectangular sheet is folded upon itself along a first crease that is parallel with two edges of the sheet. The position of the fold is located to create a structure having a region of double thickness but in which one of the edges is offset from the other. The folded structure is folded upon itself along a second crease that is parallel with the first crease to provide a first flap of double thickness that lies upon one surface of the structure. The structure also is folded upon itself along a third crease that is parallel with the first and second edges and within the region of double thickness to provide a second flap lying upon the one surface. In the totally folded sheet, the one of the edges is closer to the center of the sheet than the other edge. A unique dispenser is provided which allows the user to grasp only the one edge so that the sheet product unfolds completely when pulled from the dispenser.

5 Claims, 1 Drawing Sheet

PRIOR ART FIG. 1
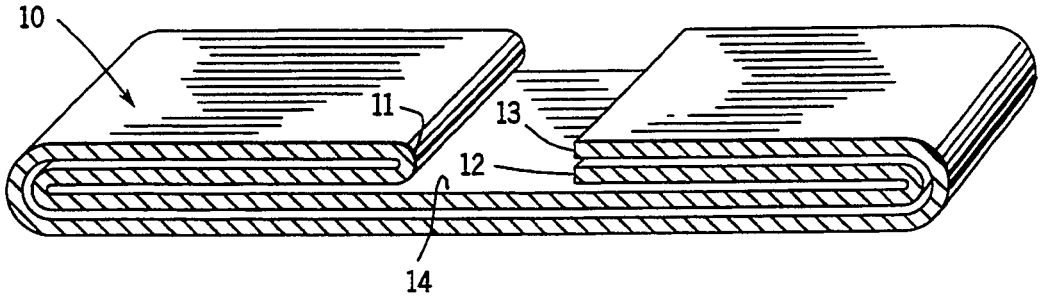
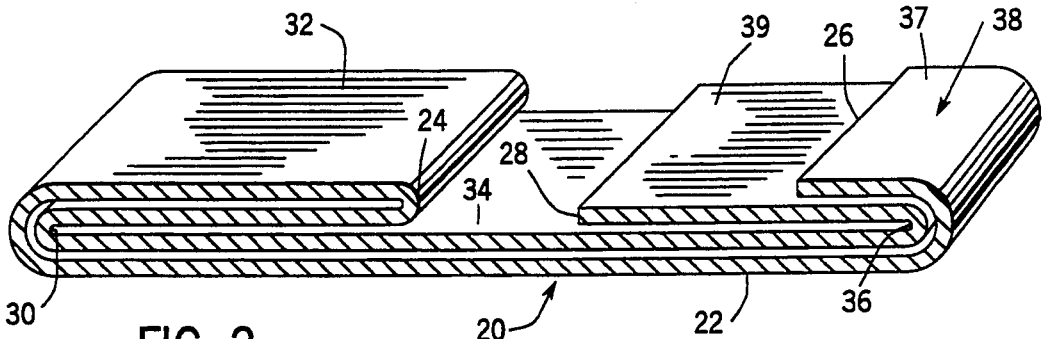
FIG. 2
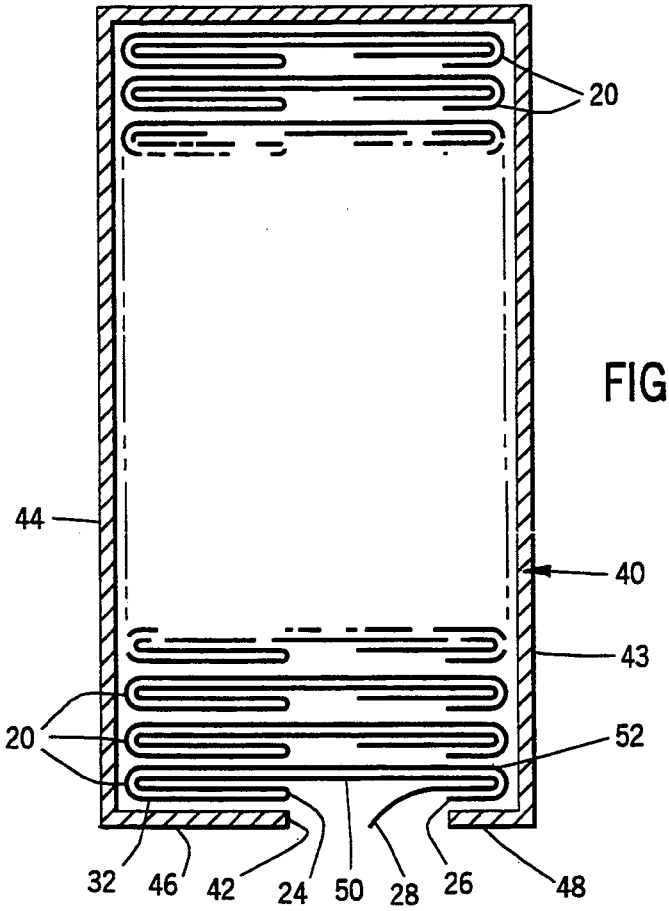
FIG. 3

FOLDED SHEET PRODUCT AND DISPENSER THEREFOR

BACKGROUND OF THE INVENTION

The present invention relates to folded sheet products, such as towels and facial tissue; and more particularly to such products which are folded for storage in a dispenser.

A wide variety of folded towels, napkins, facial tissue and the like are known in the art. For example, U.S. Pat. Nos. 1,256,334; 3,007,605 and 5,023,126 disclose different types of such products.

One form of a folded towel in commercial use is commonly referred to as a C-fold towel and is shown in FIG. 1. Such towels comprise a sheet of absorbant paper which is folded on itself along a center line so that two opposite edges 12 and 13 are aligned. This forms a two-ply structure. The two edges 12 and 13 are folded together onto one surface 14 of the towel. The folded edge 11 also is folded over onto the one surface 14 so that it is spaced from edges 12 and 13. This creates a multiple ply towel and the generally C-shape.

C-fold towels are usually stacked in a dispenser from which users withdraw them. The C-fold towel is particularly adapted for housing in a dispenser since its folded structure allows a large sheet of paper to be housed in a relatively smaller dispenser. When the towels are placed into the dispenser, edges 11, 12 and 13 are placed downward so that the lower most towel in the stack lies against the bottom wall of the dispenser. That wall has an elongated opening which exposes edges 11, 12 and 13 to the user. In withdrawing a towel from the dispenser, the user grasps either folded edge 11 or both edges 12 and 13 and pulls the towel through the opening in the dispenser. Regardless of which edge is grasped by the user, the towel unfolds into a two-ply sheet as it is withdrawn from the dispenser. Should the user wish a larger towel area, the withdrawn towel then must be unfolded into a single ply sheet.

SUMMARY OF THE INVENTION

A general object of the present invention is to provide a sheet product which is folded in a manner so that when it is withdrawn from a dispenser, the product unfolds into a single-ply sheet without requiring further unfolding steps once the product is withdrawn from the dispenser.

This objective is accomplished by folding a sheet of absorbent material upon itself along a first line which is parallel with first and second edges of the sheet and which is removed from a center line between the first and second edges. This forms a structure having a region of double thickness that terminates at the first edge which is disposed inwardly of the second edge. The structure then is folded upon itself along a second line parallel with the first line and within the region of double thickness. This second folding provides a first flap of double thickness that lies upon one surface of the structure. The structure also is folded upon itself along a third line that is parallel with the first and second edges and within the region of double thickness. This third fold provides a second flap of double thickness that lies upon the one surface wherein the second edge is closer to the one surface than the first edge which is spaced by one ply of the material from that surface.

When the sheet product of this folded construction is placed within a dispenser, the user is able to grasp the second edge in order to pull the towel from the dispenser. That pulling operation automatically causes the towel to unfold into a single sheet as it is withdrawn from the dispenser. In the preferred usage of the present invention, a special dispenser is provided which allows the user access only to the second edge forcing the user to grasp only that edge and properly withdraw the towel from the dispenser.

BRIEF DESCRIPTION OF THE DRAWINGS

FIG. 1 is a cross section view through a conventional C-fold towel known in the art;

FIG. 2 is a cross section through a C-fold towel according to the present invention; and FIG. 3 is a cross section view through a dispenser which houses a plurality of C-fold towels of the type shown in FIG. 2.

DETAILED DESCRIPTION OF THE INVENTION

With initial reference to FIG. 2, a towel 20 is formed from a generally rectangular sheet of absorbant material, such as paper or cloth, which has a predefined thickness. The sheet 22 is folded upon itself along a first line or crease that is parallel to first and second edges 26 and 28, respectively, thus forming a folded edge 24 along the first line. The first fold operation creates a structure having a region of double thickness which terminates at the first edge 26 that is disposed inwardly of the second edge 28 at that intermediate stage of the fabrication process.

The structure then is folded upon itself along a second line or crease 30 that is parallel with the first crease and within the region of double thickness. This second folding operation provides a first flap 32 which lies upon one surface 34 of the folded structure.

The structure also is folded upon itself along a third line or crease 36 that is parallel with the first and second edges and within the region of double thickness. This third fold provides a second flap 38 which lies upon the one surface 34 of the folded structure. Because the first folding operation did not align the first and second edges 26 and 28, these edges are spaced from one another on the second flap 38. The first edge 26 in the completely folded towel is spaced further from the center line of the folded towel than the second edge 28. Thus, the second flap has an outer section 37 double thickness and an inward section 39 of single ply thickness. The spacing between the first and second edges 26 and 28 is key to the towel's ability to unfold into a single sheet.

With reference to FIG. 3, a plurality of towels 20 are stacked on top of one another within a dispenser 40. The towels are placed with the edges 24, 26 and 28 facing downward toward an end of the dispenser which has an opening 42 through which the towels can be extracted. The opening 42 is offset from the midpoint between the vertical walls 43 and 44 of the dispenser. Specifically, the end wall is formed by first partition 46 and a second partition 48. The first partition 46 extends from the first vertical wall 44 toward the other vertical wall 43, to entirely support and conceal the first flap 32 of the bottom towel so that the user is unable to grasp the edge 24 of that flap. The shorter second partition 48 extends from the second vertical wall 43 of the dispenser 40, a distance which is approximately equal to the width of outer section 37 of the second flap 38.

Because the second edge 28 of the towel projects beyond the first edge 26, the second edge 28 extends beyond the second partition 48 and drops into the opening 42 formed between the two end wall partitions 46 and 48 of the dispenser 40.

Thus, only the second edge 28 of the towel is presented to the user when attempting to withdraw a towel 20 from the dispenser 40. Edges 24 and 26 of the towel 20 are concealed from being grasped by the user. Therefore, the user is drawn to grasp the second edge 28 in order to remove a towel from the dispenser. As the user, grasping the second edge 28, pulls the towel from the dispenser, a first ply 50 of the towel is withdrawn while the second ply 52 remains within the dispenser. The first ply is withdrawn, unfolding the towel about the third fold line 36 and then the first fold edge 24. Once the first ply 50 has been extracted from the dispenser 40, the second ply 52 begins to be pulled therefrom in an unfolded manner so that the towel will be unfolded completely into a single sheet when it is fully withdrawn from the dispenser. The user does not have to perform any further unfolding of the towel 20 in order to have a single ply sheet of towel to use.

Although the present invention has been described in the context of a towel, the present invention also can be used to fold other types of sheet products, such as facial tissues and napkins. Furthermore, while the towel was described as being rectangular, it may have rounded corners and curved edges.

I claim:

1. A folded product comprising a rectangular sheet of absorbent material of predefined thickness which is:

(a) folded upon itself along a first crease parallel with first and second edges of the sheet and removed from a center line between the first and second edges, thereby forming a structure having a region of double thickness which terminates at the first edge that is disposed inwardly of the second edge;

(b) said structure being folded upon itself along a second crease parallel with the first crease and within the region of double thickness to provide a first flap of double thickness lying upon one surface of said structure; and (c) said structure being folded upon itself along a third crease parallel with the first and second edges and within the region of double thickness to provide a second flap of double thickness lying upon the one surface.

2. The folded product recited in claim 1 wherein in the second flap, the second edge is located closer to the one surface than the first edge.

3. The folded product recited in claim 1 wherein the first and second edges of the second flap are spaced from the first flap.

4. A folded sheet product comprising a rectangular sheet of absorbent material of predefined thickness which is:

(a) folded upon itself along a first line parallel with first and second edges of the sheet and removed from a center line between the first and second edges, thereby forming a structure having a region of double thickness which terminates at the first edge that is disposed inwardly of the second edge;

(b) said structure being folded upon itself along a second line parallel with and proximate to the first line and within the region of double thickness to provide a first flap of double thickness lying upon one surface of said structure; and (c) said structure being folded upon itself along a third line parallel with and proximate to the first and second edges and within the region of double thickness to provide a second flap of double thickness lying upon the one surface with the second edge being closer to the one surface than the first edge.

5. A combination of a dispenser and a folded sheet product within the dispenser wherein:

the folded sheet product comprises a rectangular sheet of absorbent material of predefined thickness and being:

(a) folded upon itself along a first crease parallel with first and second edges of the sheet and removed from a center line between the first and second edges thereby forming a structure having a region of double thickness which terminates at the first edge which is disposed inwardly of the second edge, (b) said structure being folded upon itself along a second crease parallel with the first crease and within the region of double thickness to provide a first flap of double thickness lying upon one surface of said structure, and (c) said structure being folded upon itself along a third crease parallel with the first and second edges and within the region of double thickness to provide a second flap of double thickness lying upon the one surface with the second edge being closer to the one surface than the first edge; and the dispenser comprises a housing having a plurality of walls with an opening being formed in one of said walls through which the towel can be extracted and the opening being positioned to conceal the first and second flaps of the folded sheet product so that only the second edge extends into the opening.

* * * * *